US007673684B2

(12) United States Patent
Cobb

(10) Patent No.: US 7,673,684 B2
(45) Date of Patent: Mar. 9, 2010

(54) ESP/SEPARATOR ASSEMBLY AND METHOD

(76) Inventor: Delwin E. Cobb, 2323 Parana Dr., Houston, TX (US) 77080

( * ) Notice: Subject to any disclaimer, the term of this patent is extended or adjusted under 35 U.S.C. 154(b) by 0 days.

(21) Appl. No.: 12/108,568

(22) Filed: Apr. 24, 2008

(65) Prior Publication Data

US 2009/0266561 A1 Oct. 29, 2009

(51) Int. Cl.
*E21B 43/00* (2006.01)

(52) U.S. Cl. ..... 166/265; 166/105; 166/105.1; 166/105.5; 166/65.1; 166/370

(58) Field of Classification Search ..... 166/105.5, 166/105.1, 105, 65.1, 370
See application file for complete search history.

(56) References Cited

U.S. PATENT DOCUMENTS 5,642,781 A 7/1997 Richard
6,189,617 B1 2/2001 Sorhus et al.
6,382,317 B1 * 5/2002 Cobb ..... 166/265
6,412,563 B1 7/2002 St. Clair et al.
6,568,475 B1 * 5/2003 Grubb et al. ..... 166/305.1

* cited by examiner

*Primary Examiner*—Jennifer H Gay
*Assistant Examiner*—Yong-Suk Ro
(74) *Attorney, Agent, or Firm*—Browning Bushman P.C.

(57) ABSTRACT

An ESP/separator assembly (10) is positioned downhole in a well on a tubular string (18) to pump downhole fluids to the surface. The assembly includes an electric submersible pump (12) and an electrically powered motor (20) positioned below the pump. An electrical cable (22) extends downhole past the motor and to the pump. A generally cylindrical shroud (26) is positioned circumferentially about the pump, the motor, and a portion (24) of the cable extending past the pump and to the motor. A separator (60) is provided at the lower end of the shroud, such that the shroud supports substantially the weight of the separator.

16 Claims, 3 Drawing Sheets

ESP/SEPARATOR ASSEMBLY AND METHOD

FIELD OF THE INVENTION

The present invention relates to an electric submersible pump (ESP) for positioning downhole in a well on a tubular string to pump downhole fluids to the surface. More particularly, the invention relates to ESP/separator assembly wherein a generally tubular shroud is positioned circumferentially about a pump, the motor and a portion of an electrical cable extending past the pump and motor to support substantially the weight of the separator.

BACKGROUND OF THE INVENTION

Various types of pumping systems have been devised to pump fluid from a downhole formation to the surface. One such pump is an electric submersible pump (ESP) which is powered by an electric motor positioned downhole for powering the pump, with an electrical cable conventionally extending downhole past the pump and to the motor.

In many applications, solid particles (e.g., sand) or gas bubbles may significantly detract from the efficiency of the pump, and may lead to pump damage. While various types of desanders and gas separators have been devised for removing sand and gas from downhole fluids before entering a pump, such equipment is conventionally operated by merely suspending the separator from the pump and motor, so that fluid passes through the separator before bypassing the motor and entering the pump.

The disadvantages of the prior art are overcome by the present invention, which discloses improved techniques for assembling and operating an ESP/separator assembly.

SUMMARY OF THE INVENTION

In one embodiment, an ESP/separator assembly is positioned downhole in a well on a tubular string to pump downhole fluids to the surface. An electric submersible pump has an upper end for fluid communication with an interior of a tubing string, and an electrically powered motor positioned below the pump. An electrical cable extends downhole past the pump and to the motor. A generally sleeve-shaped or tubular shroud is positioned circumferentially about the pump, the motor, and a portion of the cable extending past the pump and to the motor. The shroud has an upper end connected to the tubular string and a lower end axially opposite the pump with respect to the motor. A separator having an upper end in fluid communication with and connected to the lower end of the shroud is provided, such that the shroud supports substantially the weight of the separator. Downhole fluid moves upward through the separator and passes through an interior of the shroud and into the pump and then into the tubular string. The separator may either be a gas separator or a desander, and a mud anchor may be positioned below the desander.

In one embodiment, the pump has an outlet with a central axis radially spaced from a central axis of the lower end of the tubular string, such that the pump is eccentrically positioned within the shroud to position the cable radially between an exterior surface of the pump and an interior surface of the shroud. A coupling may be provided between a lower end of the tubular string and the upper end of the shroud. A pipe nipple may extend between the lower end of the coupling and an upper end of a pump, with a pipe nipple having a central axis offset from the central axis of the shroud. The upper end of the shroud may be fluidly sealed to the tubular string, such that fluid enters the shroud only through its lower end.

These and further features and advantages of the present invention will become apparent from the following detailed description, wherein reference is made to the figures in the accompanying drawings.

DETAILED DESCRIPTION OF PREFERRED EMBODIMENTS

Figure 1:
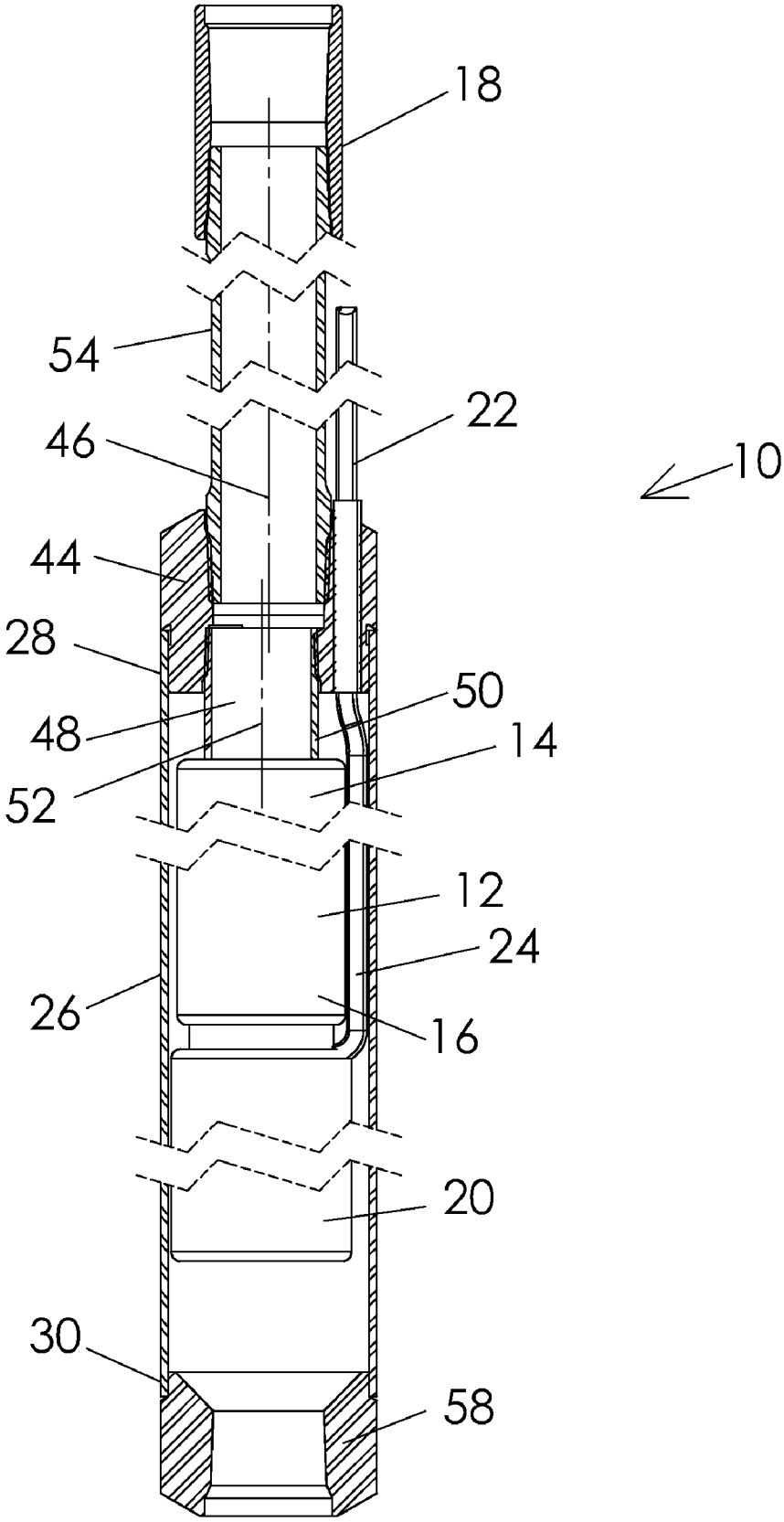
FIG. 1 is a cross-sectional view of an ESP pump, motor, and shroud according to one embodiment of the present invention.

FIG. 1 depicts one embodiment of an electrical submersible pump as part of an ESP assembly for positioning downhole in a well on a tubular string to pump fluids to the surface. The ESP assembly 10 is suspended in the well from a pup joint 54, such that an upper end 14 of the ESP assembly 10 is in fluid communication with the interior of a tubular string 18. An electrical powered motor 20 is positioned below the pump for powering the pump. Both the pump 12 and the motor 20 may be relatively long, and are broken in FIG. 1 for clarity of the remaining components. An electrical cable 22 conventionally extends from the surface downhole (but could extend from a downhole power source above the pump) to the pump 12, and more particularly extends downhole past the pump 12 and to the motor 20 for powering the motor.

FIG. 1 also depicts a generally sleeve-shaped or tubular shroud 26 positioned circumferentially about the pump 12, the motor 20, and a portion 24 of the electrical cable 22 extending past the pump and to the motor. The shroud has an upper end 28 connected to coupling 44, which in turn is connected to the tubular string 18. The lower end 30 of the shroud axially opposite the pump with respect to the motor is connected to a lower coupling 58.

Figure 3:
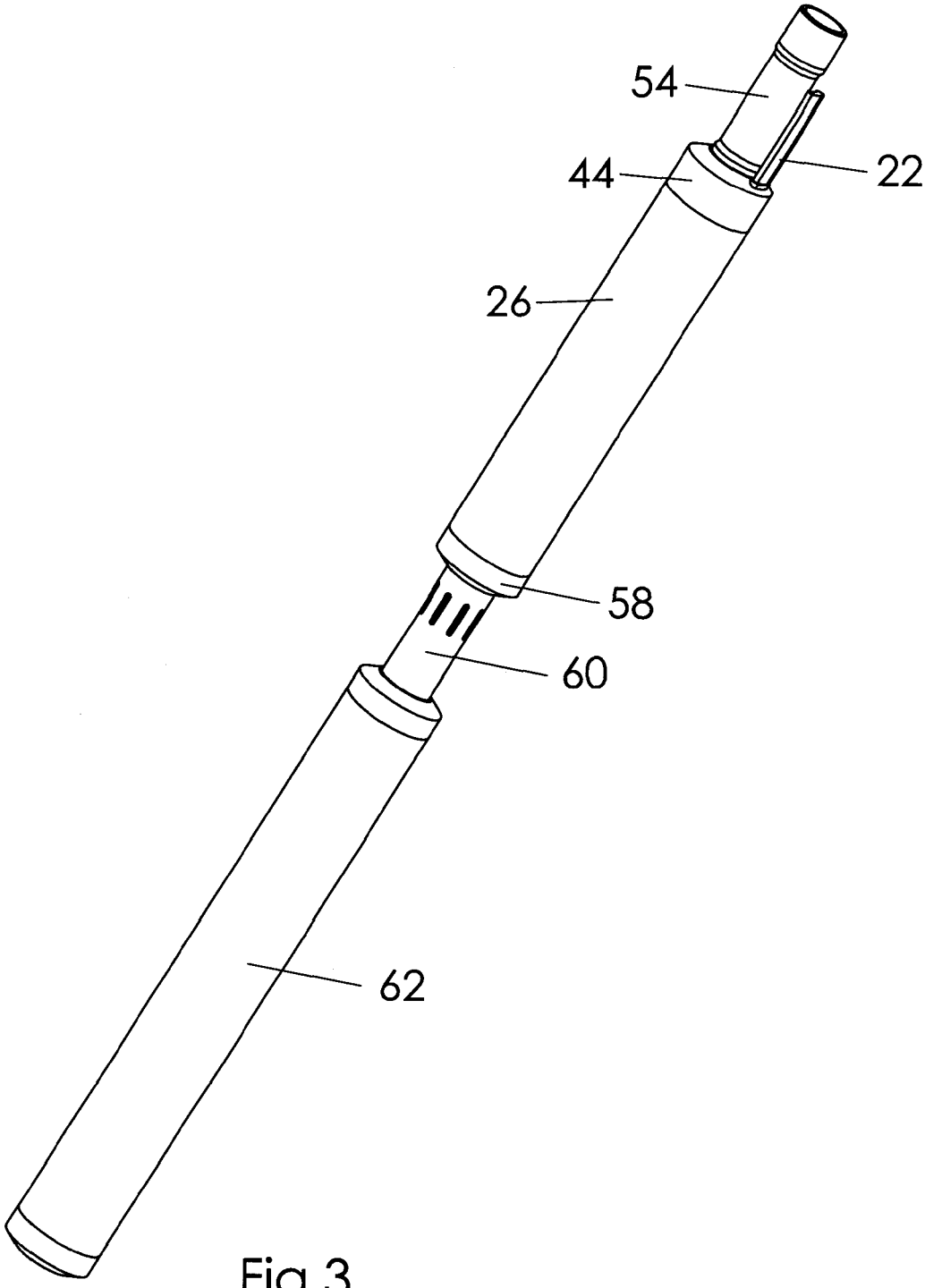
FIG. 3 is a simplified pictorial view illustrating the shroud, a gas separator or desander, and an optional mud anchor.

Referring briefly to FIG. 3, the sleeve-shaped shroud 26 is connected to the upper coupling 44, as discussed above, and also to the lower coupling 58. Coupling 58 in turn is connected to and supports separator 60, which may be a gas separator for removing gas bubbles from the downhole fluid prior to entering the interior of the shroud, or may be a desander which removes solid particles from the downhole fluid before entering the interior of the shroud. In the latter case, mud anchor 62 may be positioned below the desander for receiving separated solid particles. In either event, the shroud 26 supports potentially the weight of the separator, and in the FIG. 3 embodiment, the separator and the mud anchor. The separator and mud anchor are thus not supported substantially by either the pump 12 or the motor 20.

Referring again to FIG. 1, the pump 12 has an outlet 48 which has its axis radially spaced from the central axis 46 of a lower end of a tubular string, which is coaxial with a central axis of the shroud 26. The pump 12 is thus eccentrically positioned within the shroud and thereby positions the cable radially between an exterior surface of the pump and an interior surface of the shroud. The eccentric positioning of the pump and motor within the shroud minimizes the interior diameter of the shroud 26 and the exterior diameter of the pump, yet allows the cable to be easily and reliably positioned between the pump and the shroud, and to the motor. The shroud 26 is also relatively thin walled, so that its outer diameter allows the tool to be used in relatively small diameter wells.

The pup joint 54 thus has an axis concentric with a lower axis of the tubular 18 and with the central axis 46 of the shroud 26. The coupling 44 includes a pipe nipple 50 threadably connected thereto, with the pipe nipple having an axis 52 which is spaced from the axis 46 of the shroud, and is aligned with the axis of the outlet 14 from the pump. Thus it may be seen in FIG. 1 that the generally cylindrical pump is shifted laterally slightly so that the electrical cable may be positioned in the wide portion of the annulus between the exterior of the pump and the interior of the shroud. Pipe nipple 50 extends from the lower end of the coupling 44 to the upper end 14 of the pump, with the pipe nipple having a central axis laterally offset from the central axis 46 of the shroud 26.

The upper end of the shroud may be welded to the upper coupling 28, and the lower end of the shroud may similarly be welded to the lower coupling 58. This provides high strength for supporting the separator, and also ensures that the upper end of the shroud is fluidly sealed to the tubular string, such that fluid enters the shroud only through its lower end.

Figure 2:
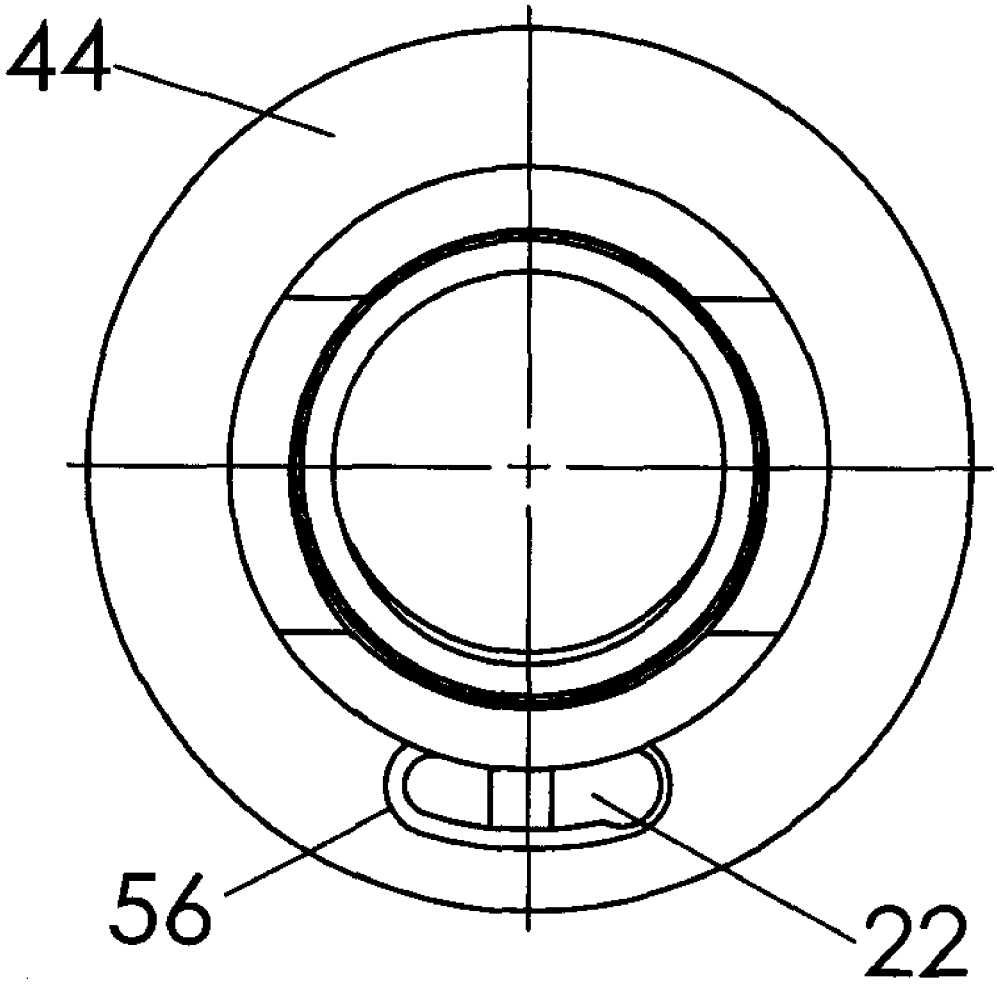
FIG. 2 is an end view of the assembly shown in FIG. 1.

FIG. 2 is a top view of the assembly shown in FIG. 1, and the channel 56 cut in the coupling 44 for receiving the electrical cable 22. The cable may be sealed to the coupling in a conventional manner.

According to the method of the invention, the upper end of the shroud is effectively connected to the tubular string, and a lower end axially opposite the pump with respect to the motor is connected to the separator. The shroud 26, and not the pump 12 and/or the motor 20, thus support substantially the entire weight of the separator, such that fluid moving upward through the separator passes through an interior of the shroud and into the pump and then into the tubular string. Fluid thus enters the shroud only through its lower end.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. An ESP/separator assembly for positioning downhole in a well on a tubular string to pump downhole fluids to the surface, comprising:

an electric submersible pump (ESP) having an upper end for fluid communication with an interior of the tubular string;

an electrically powered motor positioned below the pump for powering the pump;

an electrical cable extending downhole past the pump and to the motor;

a generally sleeve-shaped shroud positioned circumferentially about the pump, the motor, and a portion of the electrical cable extending past the pump and to the motor, the shroud having an upper end connected to the tubular string and a lower end axially opposite the pump with respect to the motor;

a separator having an upper end in fluid communication with and connected to the lower end of the shroud, such that the shroud supports substantially the weight of the separator, and fluid moving upward through the separator passes through an interior of the shroud and into the pump and then into the tubular string; and the pump having an outlet with an axis radially spaced from a central axis of a lower end of the tubular string, such that the pump is eccentrically positioned within the shroud to position the cable radially between an exterior surface of the pump and an interior surface of the shroud.

2. The ESP/separator assembly as defined in claim 1, wherein the separator is a gas separator which removes gas bubbles from the downhole fluids prior to entering the interior of the shroud.

3. The ESP/separator assembly as defined in claim 1, wherein the separator is a desander which removes solid particles from the down hole fluids prior to entering the interior of the shroud.

4. The ESP/separator assembly as defined in claim 3, further comprising:

a mud anchor positioned below the desander for receiving separated solid particles.

5. The ESP/separator assembly as defined in claim 1, further comprising:

a coupling between the lower end of the tubular string and an upper end of the shroud; and a pipe nipple extending between a lower end of the coupling and an upper end of the pump, the pipe nipple having a central axis offset from a central axis of the shroud.

6. The ESP/separator assembly as defined in claim 1, wherein the upper end of the shroud is fluidly sealed to the tubular string, such that fluid enters the shroud only through its lower end.

7. An ESP/separator assembly for positioning downhole in a well on a tubular string to pump downhole fluids to the surface, comprising:

an electric submersible pump (ESP) having an upper end for fluid communication with an interior of the tubular string;

an electrically powered motor positioned below the pump for powering the pump;

an electrical cable extending downhole past the pump and to the motor;

a generally sleeve-shaped shroud positioned circumferentially about the pump, the motor, and a portion of the electrical cable extending past the pump and to the motor, the shroud having an upper end connected to and fluidly sealed to the tubular string such that fluid enters the shroud only through its lower end positioned axially opposite the pump with respect to the motor;

a coupling extending between the lower end of the tubular string and an upper end of the shroud;

a pipe nipple extending between a lower end of the coupling and an upper end of the pump, the pipe nipple having a central axis offset from a central axis of the shroud; and a separator having an upper end in fluid communication with and connected to the lower end of the shroud, such that the shroud supports substantially the weight of the separator, and fluid moving upward through the separator passes through an interior of the shroud and into the pump and then into the tubular string.

8. The ESP/separator assembly as defined in claim 7, wherein the separator is a gas separator which removes gas bubbles from the downhole fluids prior to entering the interior of the shroud.

9. The ESP/separator assembly as defined in claim 7, wherein the separator is a desander which removes solid particles from the downhole fluids prior to entering the interior of the shroud.

10. The ESP/separator assembly as defined in claim 9, further comprising:

a mud anchor positioned below the desander for receiving separated solid particles.

11. The ESP/separator assembly as defined in claim 7, wherein the pump has an outlet axially spaced from a central axis of a lower end of the tubular string, such that the pump is eccentrically positioned within the shroud to position the cable radially between an exterior surface of the pump and an interior surface of the shroud.

12. A method of positioning an electric submersible pump (ESP) downhole in a well on a tubular string to pump downhole fluids to the surface, comprising:

connecting the pump for fluid communication with an interior of the tubular string;

electrically powering a motor positioned below the pump for powering the pump;

extending an electrical cable downhole past the pump and to the motor;

positioning a generally sleeve-shaped shroud circumferentially about the pump, the motor, and a portion of the electrical cable extending past the pump and to the motor, the shroud having an upper end connected to the tubular string and a lower end axially opposite the pump with respect to the motor;

providing a coupling between the lower end of the tubular string and an upper end of the shroud;

providing a pipe nipple between a lower end of the coupling and an upper end of the pump, the pipe nipple having a central axis offset from a central axis of the shroud; and connecting a separator in fluid communication with the lower end of the shroud, such that the shroud supports substantially the weight of the separator, and fluid moving upward through the separator passes through an interior of the shroud and into the pump and then into the tubular string.

13. The method as defined in claim 12, wherein the separator is a gas separator which removes gas bubbles from the downhole fluids prior to entering the interior of the shroud.

14. The method as defined in claim 12, wherein the separator is a desander which removes solid particles from the downhole fluids prior to entering the interior of the shroud.

15. The method as defined in claim 12, wherein the upper end of the shroud is welded to the coupling.

16. The method as defined in claim 12, wherein the upper end of the shroud is fluidly sealed to the tubular string, such that fluid enters the shroud only through its lower end.

* * * * *